US007651252B2

(12) United States Patent
Kim

(10) Patent No.: US 7,651,252 B2
(45) Date of Patent: Jan. 26, 2010

(54) HEADLAMP HAVING LED LIGHT SOURCES

(75) Inventor: Jong-Un Kim, Gyeongsan-si (KR)

(73) Assignees: SL Seobong, Cheonan-Si (KR); SL Lighting, Daegu (KR)

( * ) Notice: Subject to any disclaimer, the term of this patent is extended or adjusted under 35 U.S.C. 154(b) by 0 days.

(21) Appl. No.: 11/856,138

(22) Filed: Sep. 17, 2007

(65) Prior Publication Data

US 2008/0068853 A1 Mar. 20, 2008

(30) Foreign Application Priority Data

Sep. 15, 2006 (KR) ..... 10-2006-0089798

(51) Int. Cl.
*F21S 8/10* (2006.01)

(52) U.S. Cl. ..... 362/545; 362/543; 362/518

(58) Field of Classification Search ..... 362/517, 362/518, 519, 538, 543, 544, 545, 800
See application file for complete search history.

(56) References Cited

U.S. PATENT DOCUMENTS 7,108,412 B2 * 9/2006 Ishida et al. ..... 362/518
7,156,544 B2 * 1/2007 Ishida ..... 362/538
7,249,877 B2 * 7/2007 Johnson et al. ..... 362/545
2004/0223338 A1 * 11/2004 Koike et al. ..... 362/545
2007/0211487 A1 * 9/2007 Sormani ..... 362/545

FOREIGN PATENT DOCUMENTS

| | | |
|---|---|---|
| JP | 2003-123517 | 4/2003 |
| JP | 2003-151317 | 5/2003 |
| KR | 1020050043631 A | 5/2005 |
| WO | WO 2004/007241 A2 | 1/2004 |

* cited by examiner

*Primary Examiner*—Y My Quach Lee
(74) *Attorney, Agent, or Firm*—Edwards Angell Palmer & Dodge LLP; Kongsik Kim; Peter F. Corless

(57) ABSTRACT

Provided is a lamp unit using light-emitting-diode (LED) light sources, more particularly, a lamp unit using LED light sources which can generate a low beam and a high beam using LED light sources. The lamp unit includes a first LED light source unit which includes a first row of LED light sources; a second LED light source unit which includes a second row of LED light sources that is disposed below the first row of LED light sources; and a reflection plate which comprises a reflection surface that projects a low beam or a high beam upon turning on or off the first or second LED light source unit.

6 Claims, 4 Drawing Sheets

HEADLAMP HAVING LED LIGHT SOURCES

CROSS-REFERENCE TO RELATED APPLICATION

This application claims priority from Korean Patent Application No. 10-2006-0089798 filed Sep. 15, 2006, the disclosure of which is incorporated herein by reference in its entirety.

BACKGROUND

1. Technical Field

The present invention relates to a headlamp having light-emitting-diode (LED) light sources, and more particularly, to a headlamp having LED light sources, the headlamp being capable of generating a low beam and a high beam using LED light sources.

2. Background Art

Vehicles are generally equipped with various lights for lightening drivers' field-of-vision at night or for informing other drivers the presence of a vehicle on a road. Conventional lights for vehicles typically include a halogen lamp or a high-intensity discharge (HID) lamp as a light source. Conventional lights for vehicles also include a reflection plate which reflects light emitted from a light source forward. A reflection plate may include a coating layer which is obtained by depositing a highly-reflective material such as aluminum or silver powder on the surface of the reflection plate.

Conventional lights for vehicles are equipped with not only a light source but also a reflection plate and a lens. In addition, the fabrication of conventional lights for vehicles involves a patterning operation and a coating operation in order to provide various functions such as light reflection, emission, and dispersion functions. In short, conventional lights for vehicles have a complicated structure, include a considerable number of elements, and require a considerable number of fabrication processes, thereby increasing the manufacturing cost.

As part of the effort to address the problems associated with conventional lights for vehicles, light emitting diode (LED) lamps have been developed and widely used in headlights for vehicles. Due to the characteristics of LEDs, LED lamps are known for their long lifetime and high space efficiency.

Conventional headlights for vehicles include a low beam lamp and a high beam lamp. In order to generate a low beam and a high beam, conventional headlights for vehicles are required to include both a low beam lamp and a high beam lamp and a reflection plate for each of the low beam lamp and the high beam lamp, thereby resulting in spatial restrictions and increasing the manufacturing cost of headlights for vehicles.

In order to configure a headlamp capable of generating both a low beam and a high beam, a shield may be disposed at the front of a headlamp. However, the shield may cause a loss of light by covering part of a light source during the operation of a low beam lamp.

The information disclosed in this Background section is only for enhancement of understanding of the background of the invention and should not be taken as an acknowledgement or any form of suggestion that this information forms the prior art that is already known to a person skilled in the art.

SUMMARY OF THE INVENTION

Aspects of the present invention provide a headlamp for a vehicle which can generate a low beam and a high beam by selectively turning on or off two rows of light emitting diode (LED) light sources.

However, the aspects of the present invention are not restricted to the one set forth herein. The above and other aspects of the present invention will become more apparent to one of daily skill in the art to which the present invention pertains by referencing a detailed description of the present invention given below.

According to an aspect of the present invention, there is provided a lamp unit having LED light sources, the lamp unit including: a first LED light source unit which includes a first row of LED light sources; a second LED light source unit which includes a second row of LED light sources that is disposed below the first row of LED light sources; and a reflection plate which comprises a reflection surface that projects a low beam or a high beam upon turning on or off the first or second LED light source unit.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

The present invention will now be described more fully with reference to the accompanying drawings, in which exemplary embodiments of the invention are shown.

Figure 1:
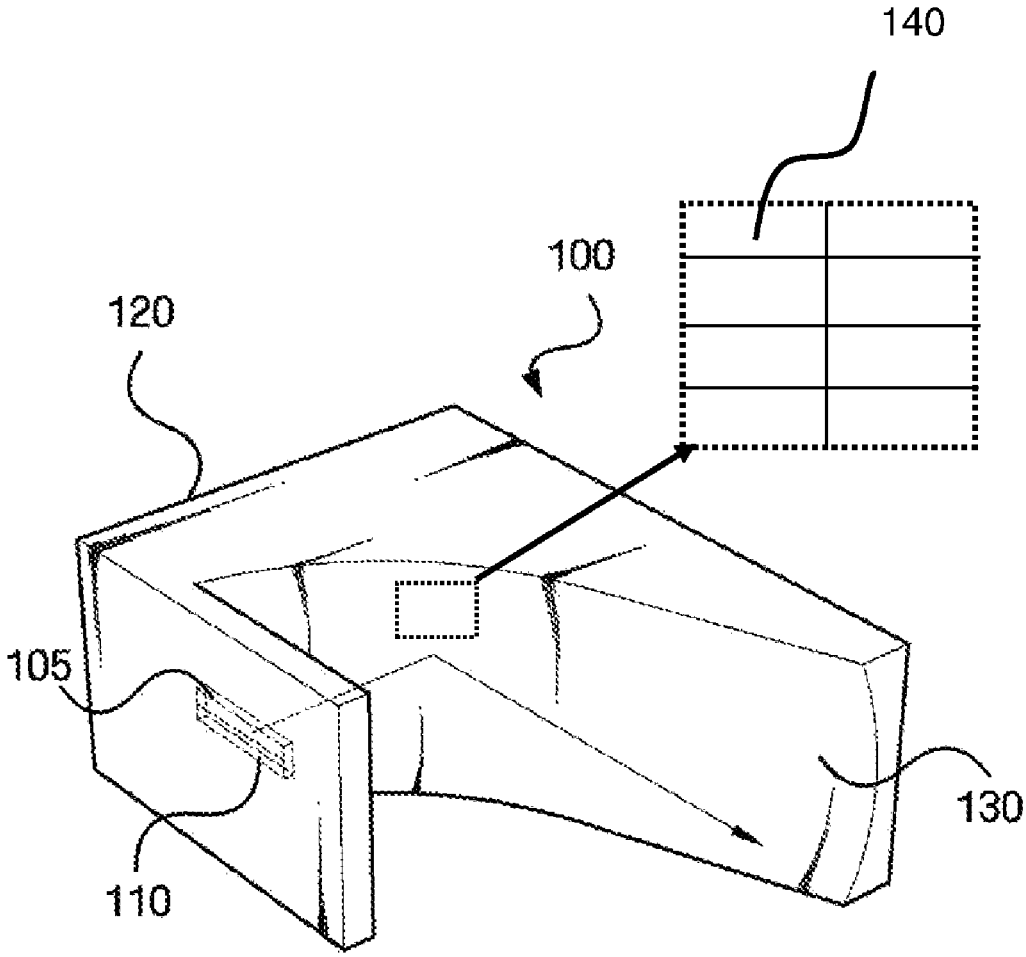
FIG. 1 is a perspective view of a lamp unit having light emitting diode (LED) light sources, according to an embodiment of the present invention.
Figure 2:
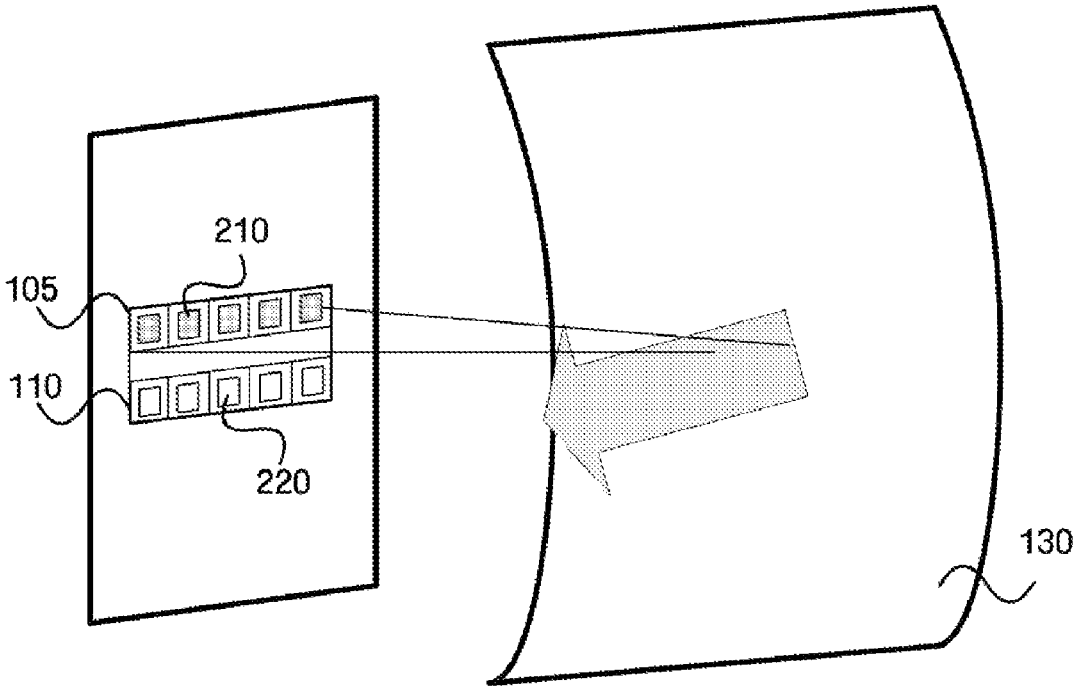
FIG. 2 illustrates the principle of generating a low beam by the lamp unit illustrated in FIG. 1.
Figure 3:
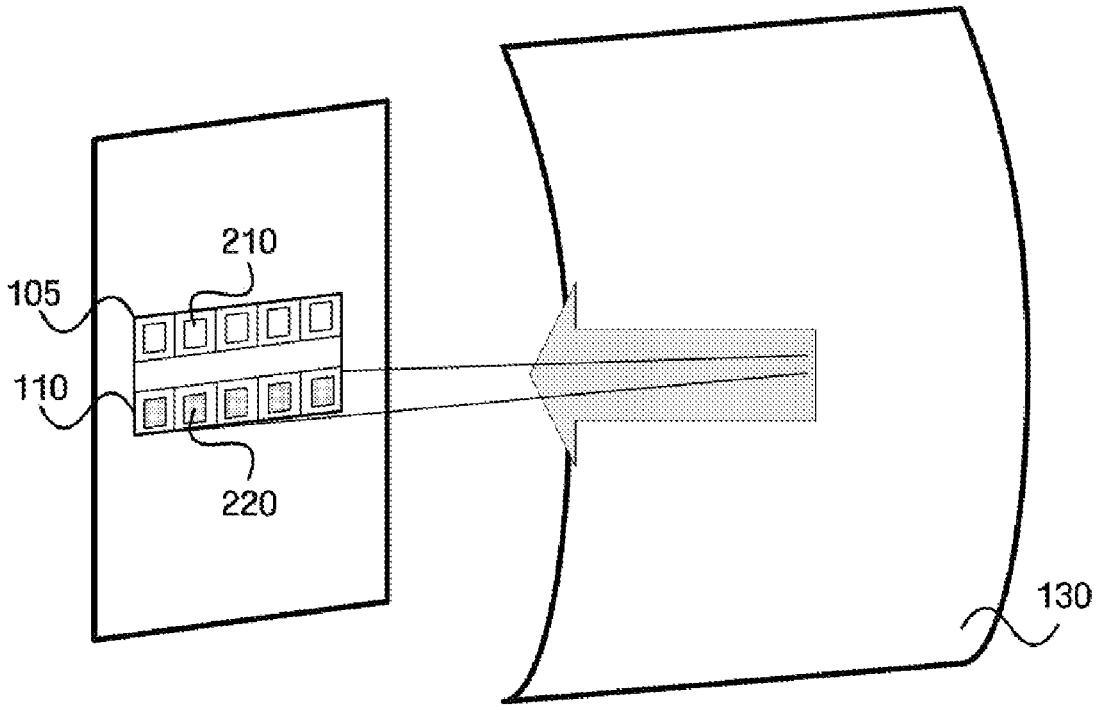
FIG. 3 illustrates the principle of generating a high beam by the lamp unit illustrated in FIG. 1.

FIG. 1 is a perspective view of a lamp unit 100 having light emitting diode (LED) light sources, according to an embodiment of the present invention, FIG. 2 illustrates the principle of generating a low beam by the lamp unit 100, and FIG. 3 illustrates the principle of generating a high beam by the lamp unit 100.

Referring to FIG. 1, the lamp unit 100 according to an embodiment of the present invention includes a first LED light source unit 105, a second LED light source unit 110, and a reflection plate 120 which reflects light generated by the first or second LED light source unit 105 or 110 forward.

The first and second LED light source units 105 and 110 each are used as a light source and include one or more LED light sources. The amount of light produced by a lamp unit using an LED light source is generally less than the amount of light produced by a lamp unit using a high-intensity discharge (HID) lamp or using a halogen light source. In order to address this, the lamp unit 100 may use a plurality of LED light sources. Referring to FIG. 2, the first and second LED light source units 105 and 110 may constitute an LED module including two rows of LED light sources. More specifically, the first and second LED light source units 105, 110 may respectively include a row of one or more LED light sources 210 and a row of one or more LED light sources 220 to increase the amount of light emitted. For example, referring to FIG. 2, the first LED light source unit 105 may include a row of five LED light sources 210, and the second LED light source unit 110 may include a row of five LED light sources 220.

Each of the first and second LED light source units 105 and 110 may also include a power supply unit (not shown) which turns on or off the LED light sources 210 or 220. The first LED light source unit 105 may include an upper row of LED light sources 210, and the second LED light source unit 110 may include a lower row of LED light sources 220. The power supply units of the first and second LED light source units 105 and 110 may generate a low beam or a high beam by turning on or off the first and second LED light source units 105 and 110, as shown in FIGS. 2 and 3. For example, when the first LED light source unit 105 is turned on and the second LED light source unit 110 is turned off, light emitted from the upper row of LED lights sources 210 is reflected downward by the reflection plate 120, thereby generating a low beam, as shown in FIG. 2.

LEDs are light emitting devices with a luminous flux higher than a predetermined Lumen level, and may be used as light sources for a lamp unit. According to an embodiment of the present invention, a light source may include an LED module which has a plurality of LEDs with a luminous flux of 10-250 lumen. In this case, the total luminous flux of the LED may account for 600-1000 lumen, thereby satisfying a required luminous flux for standard LEDs.

The reflection plate 120 comprises a reflection surface 130 that reflects light emitted from the first or second LED light source unit 105 or 106 forward. The reflection surface 130 can be provided with one or more cells 140 with different curvature radiuses or focal points. In this case, it is possible to control the direction and the dispersion of light emitted from the first or second LED light source unit 105 or 110 in units of cells of the reflection plate 120 and thus to generally control the patterns of beams.

The reflection surface 130 is opposite to the first or second LED light source unit 105 or 110, not surrounding the first or second LED light source unit 105 or 110.

The reflection plate 120 may have various structures. For example, a parabolic reflection plate, a linear reflection plate, or an optical reflection plate may be used as the reflection plate 120. The main body of the reflection plate 120 may be formed of a metal such as steel or flame-resistant steel or a heat-resistant plastic material such as a heat-resistant polycarbonate (PC). The main body of the reflection plate 120 may include a coating layer obtained by depositing a highly-reflective material such as aluminum or silver powder in a vacuum or non-vacuum atmosphere.

The reflection surface 130 may have a predetermined angle so as to reflect light emitted from the first or second LED light source unit 105 or 110 forward, as illustrated in FIG. 1.

An operation of the lamp unit 100 will hereinafter be described in detail with reference to FIGS. 4A and 4B.

Figure 4A:
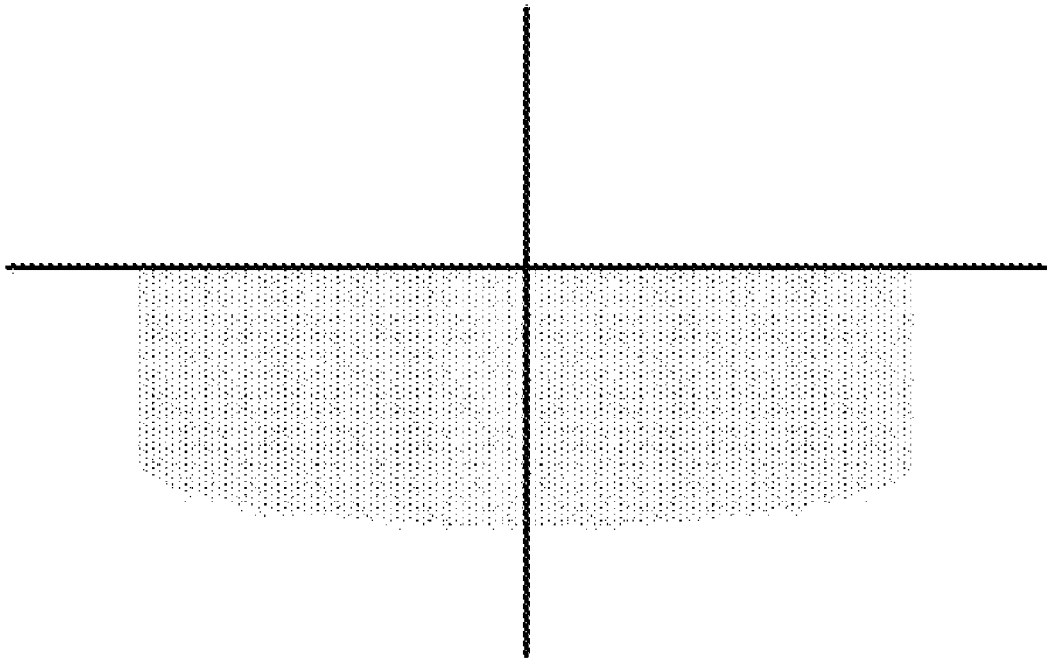
FIGS. 4A and 4B illustrate the patterns of a low beam and a high beam, respectively, generated by the lamp unit illustrated in FIG. 1.
Figure 4B:
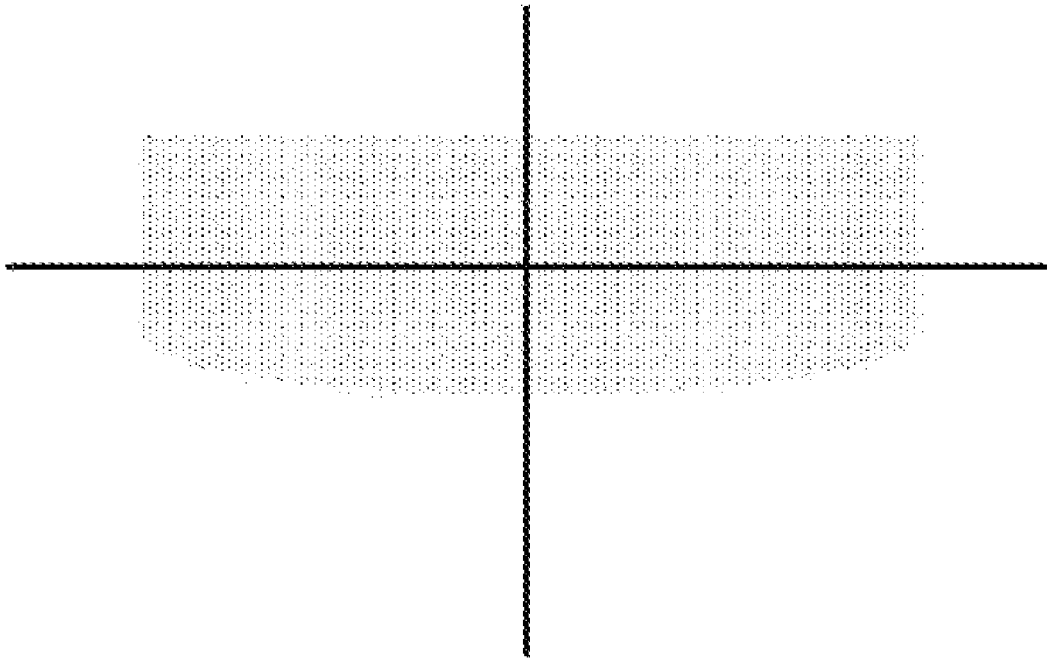

FIGS. 4A and 4B illustrate the patterns of a low beam and a high beam, respectively, generated by the lamp unit 100.

The first and second LED light units 105 and 110 may provide a light source for the lamp unit 100. The first and second LED light units 105 and 110 may respectively include two rows of LED light sources, and may be selectively turned on or off according to whether a beam to be generated is a high beam or a low beam.

For example, in order to generate a low beam, the first LED light source unit 105 may be turned on, and the second LED light source unit 110 may be turned off. In this case, light emitted from the first LED light source unit 105, which is located above the second LED light source unit 110, may be projected low as a low beam after being reflected by the reflection plate 120. Here, as the angle of incidence of light becomes large, the angle of reflection also becomes large.

On the other hand, a high beam may be generated by turning off the first LED light source unit 105 and turning on the second LED light source unit 110. The angle of incidence of light is less when the second LED light source unit 110 is turned on, as illustrated in FIG. 3, than when the first LED light source unit 105 is turned on. Thus, the angle of reflection of light is also less when the second LED light source unit 110 is turned on than when the first LED light source unit 105 is turned on. Therefore, light emitted from the second LED light source unit 110 may be projected high as a high beam after being reflected by the reflection surface 130.

As another example, a high beam may be generated by turning on the first LED light source unit 105 and the second LED light source unit 110. The intensity by the first LED light source unit 105 and the second LED light source unit 110 could be increased more than the case of turning on only the second LED light source unit 110.

According to the present invention, it is possible to generate a low beam or a high beam by selectively turning on or off two rows of LED light sources, without requiring a mechanical manipulation.

In addition, according to the present invention, it is possible to generate both a low beam and a high beam using a lamp unit or multiple lamp units while increasing the space efficiency.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A headlamp for a vehicle having at least one lamp unit, wherein the lamp unit comprises:

a first LED light source unit which comprises a plurality of LED light sources in a first row;

a second LED light source unit which comprises a plurality of LED light sources in a second row at a position lower than the first row;

the first and second LED light source units being arranged on only one side of the lamp unit; and a reflection plate which comprises a reflection surface that is provided commonly for the light sources of the first and second LED light source units, is opposite to the first LED light source unit and the second LED light source unit, reflects the light emitted by the first LED light source unit, the second LED light source unit or both, is provided with one or more cells with different curvature radiuses or focal points, and projects a low beam or a high beam when the first or second LED light source unit is turned on or off.

2. The headlamp of claim 1, further comprising a power supply unit which turns on or off the first or second LED light source unit.

3. A headlamp for a vehicle having at least one lamp unit, wherein the lamp unit comprises:

a first LED light source unit which comprises a plurality of LED light sources in a first row;

a second LED light source unit which comprises a plurality of LED light sources in a second row at a position lower than the first row;

the first and second LED light source units being arranged on only one side of the lamp unit; and a reflection plate which comprises a reflection surface that is provided commonly for the light sources of the first and second LED light source units, is opposite to the first LED light source unit and the second LED light source unit, reflects the light emitted by the first LED light source unit, the second LED light source unit or both, is provided with one or more cells with different curvature radiuses or focal points, and projects a low beam or a high beam when the first or second LED light source unit is turned on or off, wherein the low-beam is generated by turning on the first LED light source unit and a high-beam is generated by turning on the second LED light source unit.

4. The headlamp of claim 3, further comprising a power supply unit which turns on or off the first or second LED light source unit.

5. A headlamp for a vehicle having at least one lamp unit, wherein the lamp unit comprises:

a first LED light source unit which comprises a plurality of LED light sources in a first row;

a second LED light source unit which comprises a plurality of LED light sources in a second row at a position lower than the first row;

the first and second LED light source units being arranged on only one side of the lamp unit; and a reflection plate which comprises a reflection surface that is provided commonly for the light sources of the first and second LED light source units, is opposite to the first LED light source unit and the second LED light source unit, reflects the light emitted by the first LED light source unit, the second LED light source unit or both, is provided with one or more cells with different curvature radiuses or focal points, and projects a low beam or a high beam when the first or second LED light source unit is turned on or off, wherein the low-beam is generated by turning on the first LED light source unit and the high-beam is generated by turning on the first and the second LED light source unit.

6. The headlamp of claim 5, further comprising a power supply unit which turns on or off the first or second LED light source unit.

* * * * *